US005092619A

United States Patent [19]

Leichtfried et al.

[11] Patent Number: 5,092,619

[45] Date of Patent: Mar. 3, 1992

[54] SKI BRAKE

[75] Inventors: Friedrich Leichtfried, Traiskirchen; Hubert Wuerthner, Hainburg/Donau, both of Austria

[73] Assignee: TMC Corporation, Baar, Switzerland

[21] Appl. No.: 466,312

[22] PCT Filed: Aug. 19, 1989

[86] PCT No.: PCT/EP89/00977

§ 371 Date: Apr. 27, 1990

§ 102(e) Date: Apr. 27, 1990

[87] PCT Pub. No.: WO90/02588

PCT Pub. Date: Mar. 22, 1990

[30] Foreign Application Priority Data

Sep. 1, 1988 [AT] Austria ..... A 2152/88

[51] Int. Cl.[5] ..... A63C 7/10

[52] U.S. Cl. ..... 280/605

[58] Field of Search ..... 280/604, 605, 607, 618, 280/617

[56] References Cited

U.S. PATENT DOCUMENTS 4,973,072 11/1990 Stritzl et al. ..... 280/605

5,002,303 3/1991 Freisinger et al. ..... 280/605

FOREIGN PATENT DOCUMENTS 45698 2/1982 European Pat. Off. .

227939 7/1987 European Pat. Off. .

2388572 11/1978 France .

2512682 3/1983 France .

7515 12/1987 World Int. Prop. O. .

*Primary Examiner*—Andres Kashnikow

*Assistant Examiner*—Michael Mar

*Attorney, Agent, or Firm*—Flynn, Thiel, Boutell & Tanis

[57] ABSTRACT

A ski brake (1) comprising two wire-brake arms (7) pivotally supported in a base plate (2), which wire-brake arms can be pivotally moved into their ready or retracted position by pressing down an operating pedal (5) against the force of an erecting spring (6). The end sections (*7d*) of the wire-brake arms (7) are housed in the operating pedal (5) and are connected by a connecting spring (8), to which an intermediate member (9) is hinged. An extension (*9b*) of the intermediate member (9) is supported on a support surface (*2f*) of the base plate (2). In order to enable a reliable functioning of this ski brake (1) also under difficult conditions and in order to prevent a snagging of the wire-brake arms (7) on the upper side or the side edges of the ski (10), the invention provides that between the area of the base plate (2) carrying the support surface (*2f*) and the crossbar (*9k*) of the intermediate member (9) there is provided an elastically flexible interconnection.

4 Claims, 2 Drawing Sheets

SKI BRAKE

FIELD OF THE INVENTION

The invention relates to a ski brake. A similar ski brake is known for example from AT-8701243.

BACKGROUND OF THE INVENTION

A rigid intermediate member is hinged in the ski brake on bent end sections of two multiply bent wire-brake arms, which end sections are housed in the operating pedal. The intermediate member has a cylindrical sleeve and an extension following the sleeve, which extension, in the ready position of the ski brake, is supported on a support surface of the base plate against the force of a connecting spring connecting the bent end sections of the wire-brake arms.

This ski brake has proven to be successful, however, it was found that certain unfavorable circumstances can hinder the pivoting movement of the brake arms from the ready position into the braking position. For example, the brake arms can be bent caused by a rough operation or it is possible that the width of the skis is greater than is generally common. It can then happen that at least one brake arm gets caught on the side edge of the ski and the braking action is reduced or does not take place.

The goal of the invention is to improve this known ski brake so that a pivoting of the brake arms into the ready position occurs reliably also under unfavorable conditions.

SUMMARY OF THE INVENTION

A ski brake comprising two wire-brake arms pivotally supported in a base plate, which wire-brake arms can be pivotally moved into their ready or retracted position by pressing down an operating pedal against the force of an erecting spring. The end sections of the wire-brake arms are housed in the operating pedal and are connected by a connecting spring, to which an intermediate member is hinged. An extension of the intermediate member is supported on a support surface of the base plate. In order to enable a reliable functioning of this ski brake also under difficult conditions and in order to prevent a snagging of the wire-brake arms on the upper side or the side edges of the ski, the invention provides that between the area of the base plate carrying the support surface and the crossbar of the intermediate member there is provided an elastically flexible interconnection. By providing an elastically flexible support between the section of the base plate carrying the support surface and the crossbar of the intermediate member, it is assured that the wire-brake arms, even under more difficult conditions during the upward pivoting movement from the ready position into the braking position, can carry out the necessary movement to the outside, thus reliably preventing the wire-brake arms from getting caught on the sides of the ski.

Due to the fact that the base plate has in its section carrying the support surface a through-going groove-shaped opening extending over the entire width of the support surface and arranged approximately parallel thereto, the support surface can, when needed, move back or rather spring back.

BRIEF DESCRIPTION OF THE DRAWINGS

Further advantages, characteristics and details of the invention will now be discussed in greater detail in connection with the drawing, which shows one exemplary embodiment of the ski brake of the invention.

DETAILED DESCRIPTION

Figure 1:
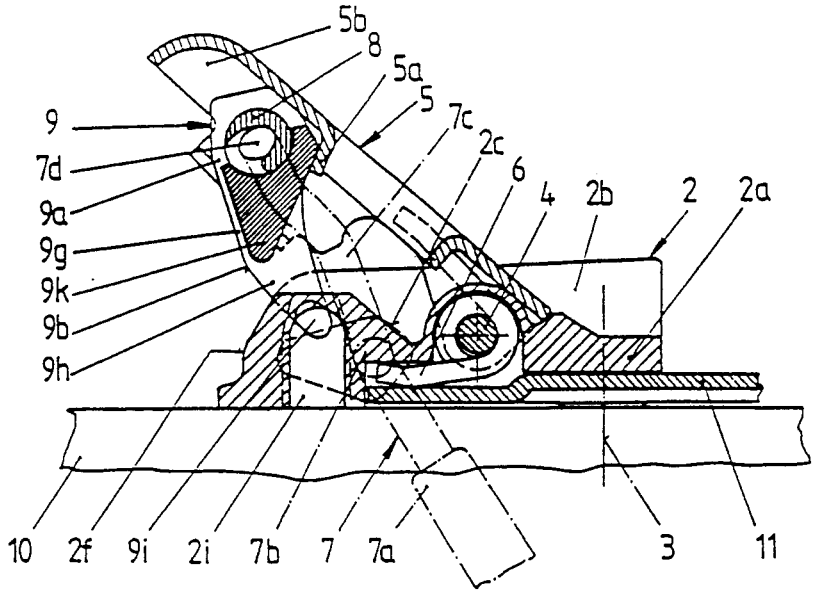
FIG. 1 is a vertical longitudinal center cross-sectional view of the ski brake in the braking position.

The ski brake illustrated in FIGS. 1 to 4 is identified in its entirety by the reference numeral 1. It has a base plate 2 with a base 2*a* fastened on a ski 10, for example, by means of only schematically indicated screws 3. FIG. 1 shows further a portion of a mounting plate 11 serving as a holding element for a ski-binding part here not illustrated and screwed together, with the base 2*a* of the ski brake 1, to the ski 10. Upwardly projecting bar-shaped side parts 2*b* are attached to the base 2*a*, which side parts 2*b* extend in longitudinal direction of the ski brake 1. A transverse axle 4 is fastened in bores in the two side parts 2*b* of the base plate 2, on which transverse axle are supported, on the one hand, an operating pedal 5 and, on the other hand, two erecting springs constructed as torsion springs 6. The operating pedal 5 has a stop 5*a* and two laterally bent plates 5*b*.

Funnel-shaped crossbores 2*c* are recessed in the side parts 2*b* of the base plate 2 spaced from the transverse axle 4. Two wire-brake arms 7, illustrated by dash-dotted lines in the drawing, are pivotally supported with their transversely extending sections 7*b* in the crossbores 2*c*. Each wire-brake arm 7 has a section lying outside of the base plate 2, which section has a plastic coating serving as a braking blade and is only schematically indicated in the drawing and hereinafter identified as a braking mandrel 7*a*. Furthermore, the brake arm 7 has the already mentioned section 7*b*, a section 7*c* following the section 7*b* and extending approximately parallel with respect to the section 7*a*, and an end section 7*d* connected at an obtuse angle to the section 7*c*. The end sections 7*d* of the two wire-brake arms 7 face one another and are connected by a connecting spring 8. The end sections 7*d* of the wire-brake arms are supported in the operating pedal 5 in a conventional and therefore not in detail described manner.

An intermediate member 9 is mounted on the connecting spring 8, which is here constructed as a helical spring. The intermediate member 9 has a cylindrical sleeve 9*a* with an extension 9*b* following the sleeve. The extension 9*b* is divided into a first section 9*g* facing the sleeve 9*a* and a second section 9*h* following the first section 9*g*, with the second section 9*h* being bent with respect to the first section 9*g*. The extension 9*b* of the intermediate member 9 is designed approximately U-shaped in the top view, with the legs of the U being formed by the second section 9*h*. The free ends of the legs have inwardly directed projections 9*i*.

A section designed as a bearing block 2*g*, directed away from the transverse axle 4 and extending in the vertical longitudinal center plane is connected to the base plate 2, which section is designed approximately I-shaped in cross section. Two grooves 2*h* of the bearing block 2*g* are thereby used to guide the projections 9*i* of the intermediate member 9. A support surface 2*f* is constructed on the face of the bearing block 2*g*. A groove-shaped opening 2*i* is constructed in the underside of the bearing block 2*g*. The longitudinal center plane of the groove-shaped opening 2*i* extends approximately parallel with the support surface 2*f*. The groove-shaped opening 2*i* extends over the entire width of the bearing block 2*g* and in elevational direction at least to the upper end of the support surface 2*f*, preferably beyond the end. The bearing block 2*g* is constructed so as to be slidingly movable with respect to the upper side of the ski 10 at least in the area supporting the support surface 2*f*.

The ski brake 1 is illustrated in its braking position in FIG. 1. The projections 9*i* of the intermediate member 9 are thereby spaced from the upper surface of the ski and are in the upper section of the groove-shaped opening 2*i*.

Figure 2:
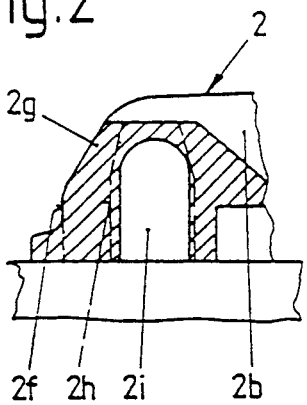
FIGS. 2 and 3 illustrate a detail of FIG. 1.
Figure 4:
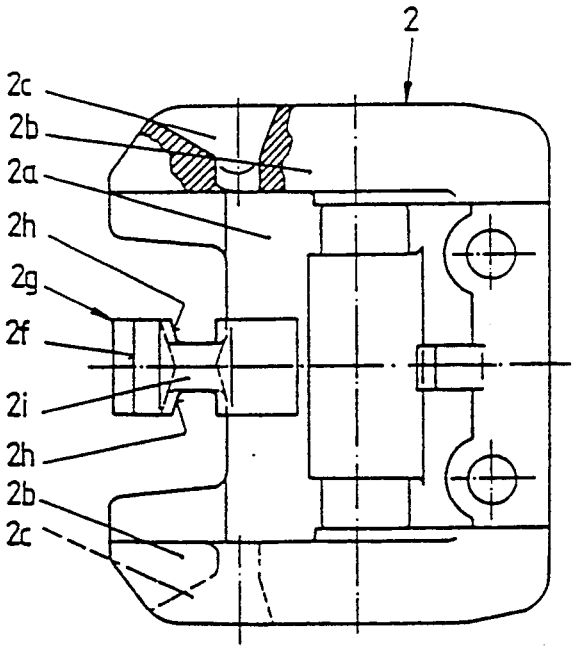
FIG. 4 is a top view of the base plate of the ski brake.
Figure 3:
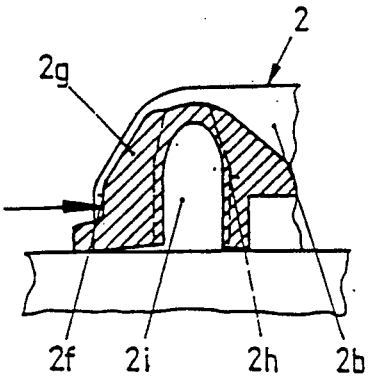
Figure 5:
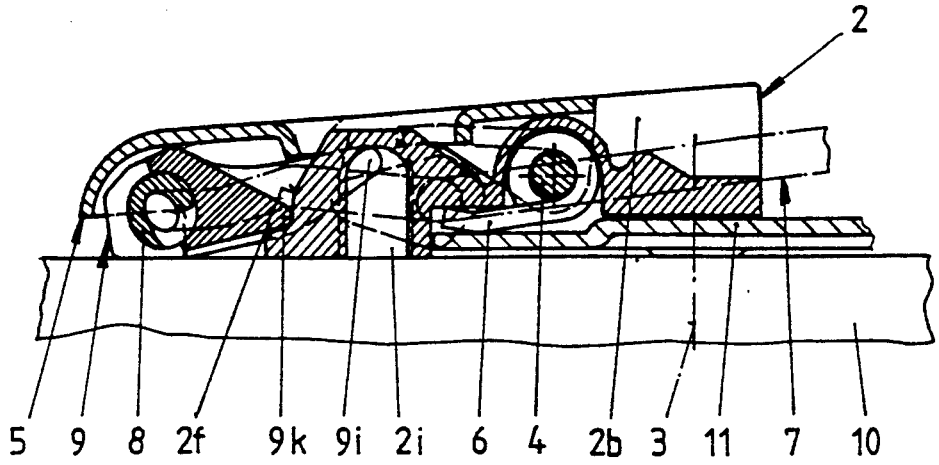
FIG. 5 is a view like FIG. 1, but with the operating pedal and brake being in the fully retracted position.

If a pressure is now, for example, applied by a ski boot onto the operating pedal 5 and same is thus swung down, then the second section 9*h* of the extension 9*d* moves in direction of the upper side of the ski. The braking mandrels 7*a* move simultaneously outwardly and upwardly. By pressing the operating pedal 5 down further, the second section 9*h* of the extension 9*b*, which second section is designed as a crossbar 9*k* and is U-shaped, rests on the support surface 2*f* of the base plate. The free end area of the second section 9*h* of the extension 9*b* moves thereby upwardly as shown in FIG. 5. The braking mandrels 7*a* simultaneously carry out a movement inwardly directed toward the longitudinal axis of the ski. Through the cooperation of the intermediate member 9 with the bearing block 2*g* and in particular with the support surface 2*f*, an exact control of the sequence of movement is possible. However, it can happen that certain outside influences, as for example slightly bent braking mandrels or skis which are too wide, require a deviation from this so to speak "preprogrammed" sequence of movement in order to guarantee the total function of the ski brake. For this purpose, it is possible to slightly deform the bearing block 2*g* of the base plate 2 in the area of the groove-shaped opening 2*i* by the action of the intermediate member 9. This situation is shown in FIGS. 2 and 3. The support surface 2*f* moves thereby back in direction of the transverse axle 4. The intermediate member 9 receives a greater clearance for movement caused by this moving back of the support surface 2*f*, thus also increasing the mobility of the wire-brake arms 7. Thus the operating pedal 5 can be set up reliably in every case and the wire-brake arms can be moved reliably in every case from the ready position into the braking position.

Figure 6:
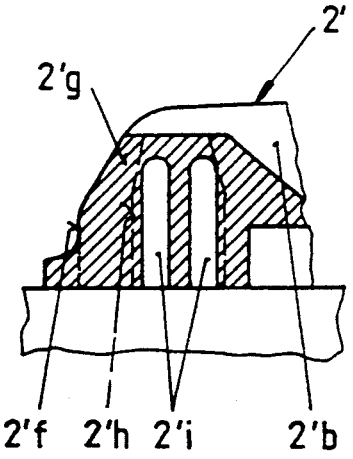
FIG. 6 is a view like FIG. 2, but of a modified construction of the bearing block.

According to a modification shown in FIG. 6, two or more narrow grooves 2'*i* are arranged parallel with one another in place of one single groove-shaped opening 2*i* in FIG. 2.

Figure 7:
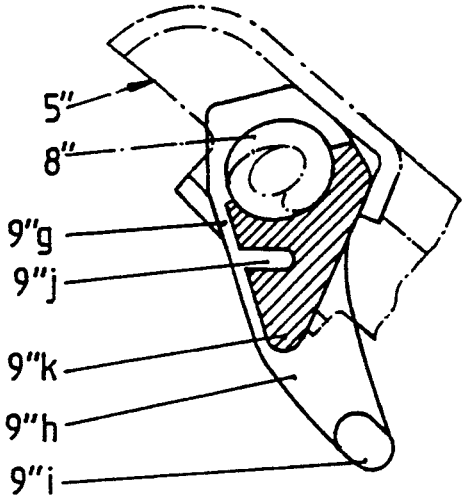
FIG. 7 is a fragmentary view of a modified form of an intermediate member.

It is also possible to realize the elastic support in the intermediate member as shown in FIG. 7. Either the support area of the crossbar can thereby be manufactured of a suitable elastic material or it is also possible to provide an elongated recess 9'*j* in the intermediate member following the crossbar and parallel to the crossbar. It is then possible in both cases to more simply design the base plate without a groove-shaped opening.

However, it would also be possible to realize the elastic support by combining the above-mentioned solutions both on the bearing block and also on the intermediate member. The just described modifications should be understood by the average man skilled in the art even without a drawing.

The embodiments of the invention in which an exclusive property or privilege is claimed are defined as follows:

1. In a ski brake comprising a base plate and two multiply bent wire-brake arms pivotally supported on said base plate for movement between a braking position wherein free ends of said wire-brake arms extend under a running surface of a ski and a retracted position wherein said wire-brake arms extend along an upper side of the ski, said wire-brake arms being held in the retracted position by an operating pedal being pressed down by a ski boot against a force of at least one erecting spring, said free ends being simultaneously swung, in the retracted position, in a direction toward a central longitudinal axis of the ski, said wire-brake arms having bent end sections housed in the operating pedal and directed to face one another and are connected by a connecting spring, an intermediate member hingedly connected to the bent end sections, said intermediate member having a cylindrical sleeve and an extension extending away from the sleeve, said extension being supported in the retracted position of the ski brake on at least one support surface on the base plate against the force of the connecting spring, the improvement wherein said base plate has a section with at least one recess therein, wherein said intermediate member has at least one crossbar thereon received in the recess, wherein the section on the base plate has the support surface thereon, which support surface extends in a direction transverse of the longitudinal axis of the ski, said section being made of an elastically flexible material so that said support surface against which said intermediate member rests is movable in a direction parallel to a longitudinal direction of the ski, wherein said recess extends over the entire width of the support surface, wherein a longitudinal center plane of said recess extends generally parallel with the support surface, and wherein the recess has a depth extending in elevational direction at least to an upper edge of the support surface.

2. The ski brake according to claim 1, wherein plural recesses are provided, a mutually adjacent pair being separated by ribs lying therebetween, said recesses each extending parallel with one another.

3. In a ski brake comprising a base plate and two multiply bent wire-brake arms pivotally supported on said base plate for movement between a braking position wherein free ends of said wire-brake arms extend under a running surface of a ski and a retracted position wherein said wire-brake arms extend along an upper side of the ski, said wire-brake arms being held in the retracted position by an operating pedal being pressed down by a ski boot against a force of at least one erecting spring, said free ends being simultaneously swung, in the retracted position, in a direction toward a central longitudinal axis of the ski, said wire-brake arms having bent end sections housed in the operating pedal and directed to face one another and are connected by a connecting spring, an intermediate member hingedly connected to the bent end sections, said intermediate member having a cylindrical sleeve and an extension extending away from the sleeve, said extension being supported in the retracted position of the ski brake on at least one support surface on the base plate against the force of the connecting spring, the improvement wherein said base plate has a section with at least one recess therein, wherein said intermediate member has at least one crossbar thereon received in the recess, wherein the section on the base plate has the support surface thereon, which support surface extends in a direction transverse of the longitudinal axis of the ski, wherein said intermediate member includes a section extending between said cylindrical sleeve and said crossbar, and wherein said section of said intermediate member is made of an elastically flexible material so that said section will flex as said intermediate member engages said support surface.

4. The ski brake according to claim 3, wherein said section of said intermediate member has an elongated recess therein extending generally parallel with respect to the longitudinal axis of the crossbar to enhance the elastic flexibility of said intermediate member.

* * * * *